US012310412B2

(12) United States Patent
Lin et al.

(10) Patent No.: US 12,310,412 B2
(45) Date of Patent: May 27, 2025

(54) ELECTRONIC CIGARETTE WITH TWO-WIRE ENCRYPTION CHIP FOR ANTI-COUNTERFEITING

(71) Applicant: HUIZHOU HAPPY VAPING TECHNOLOGY LIMITED, Guangdong (CN)

(72) Inventors: Guangrong Lin, Guangdong (CN); Xianbin Zheng, Guangdong (CN); Xiyong Zhang, Guangdong (CN)

(73) Assignee: HUIZHOU HAPPY VAPING TECHNOLOGY LIMITED, Huizhou (CN)

( * ) Notice: Subject to any disclaimer, the term of this patent is extended or adjusted under 35 U.S.C. 154(b) by 582 days.

(21) Appl. No.: 17/770,632

(22) PCT Filed: Aug. 12, 2020

(86) PCT No.: PCT/CN2020/108594
§ 371 (c)(1),
(2) Date: Apr. 21, 2022

(87) PCT Pub. No.: WO2021/077867
PCT Pub. Date: Apr. 29, 2021

(65) Prior Publication Data

US 2022/0287374 A1 Sep. 15, 2022

(30) Foreign Application Priority Data

Oct. 21, 2019 (CN) ..... 201921782073.5

(51) Int. Cl.
*A24F 40/50* (2020.01)
*A24F 40/10* (2020.01)
(Continued)

(52) U.S. Cl.
CPC ..... *A24F 40/50* (2020.01); *A24F 40/10* (2020.01); *A24F 40/46* (2020.01); *A24F 40/60* (2020.01)

(58) Field of Classification Search
CPC ..... A24F 40/60; A24F 40/50; A24F 40/46; A24F 40/40; A24F 40/20; A24F 40/10; A24F 40/00
See application file for complete search history.

(56) References Cited

U.S. PATENT DOCUMENTS

2014/0270727 A1* 9/2014 Ampolini ..... A24F 40/50 392/394
2017/0224016 A1* 8/2017 Reevell ..... H05B 3/04
(Continued)

FOREIGN PATENT DOCUMENTS

CN 207151945 U 3/2018
CN 109805451 A 5/2019
CN 209314953 U 8/2019

OTHER PUBLICATIONS

International Search Report of PCT Patent Application No. PCT/CN2020/108594 issued on Oct. 16, 2020.

*Primary Examiner* — Alex B Efta

(57) ABSTRACT

Disclosed is an electronic cigarette with a two-wire encryption chip for anti-counterfeiting, including an vaporizer assembly and a battery assembly, where the vaporizer assembly includes a two-wire encryption chip preset with an anti-counterfeit code and a heating element for heating and vaporizing cigarette liquid, the two-wire encryption chip is provided with two pins respectively connected to positive and negative electrodes of the vaporizer assembly, a circuit board is provided with a microcontroller preset with an anti-counterfeit code and a switching circuit, when the vaporizer assembly and the battery assembly are connected, the microcontroller reads the anti-counterfeit code preset in
(Continued)

the two-wire encryption chip and compares it with the anti-counterfeit code preset in the microcontroller for verification, if the two anti-counterfeit codes are the same, the microcontroller turns on the switching circuit, and the electronic cigarette enters a standby state.

9 Claims, 3 Drawing Sheets

(51) Int. Cl.
*A24F 40/46* (2020.01)
*A24F 40/60* (2020.01)

(56) References Cited

U.S. PATENT DOCUMENTS

2018/0060873 A1* 3/2018 Chu ..... G06K 19/10
2020/0315259 A1* 10/2020 Hubbard ..... A24F 40/53

* cited by examiner

ELECTRONIC CIGARETTE WITH TWO-WIRE ENCRYPTION CHIP FOR ANTI-COUNTERFEITING

TECHNICAL FIELD

The present disclosure relates to a field of the electronic cigarette technology, and more particularly, the present disclosure relates to an electronic cigarette with a two-wire encryption chip for anti-counterfeiting.

BACKGROUND

Electronic cigarettes usually include vaporizer assembly and battery assembly. The electronic cigarette is heated by the vaporizer assembly to vaporize cigarette liquid to produce vapor for a user to vape. The cigarette liquid of the electronic cigarette does not contain cigarette tar, thus the vapor produced by vaping the electronic cigarette does not contain cigarette tar, and the electronic cigarettes reduce harm to people's health to some extent. Therefore, the electronic cigarettes are widely used.

With the popularity of electronic cigarettes, the sales of electronic cigarettes in the market are also increasing year by year. Electronic cigarettes with good quality and outstanding brands are very popular with consumers and occupy a large market share. And some low-quality electronic cigarettes do not sell well, it is possible to fake or counterfeit vaporizer assembly of electronic cigarettes of outstanding brands, and to attract consumers with the advantage of low price. However, due to their poor quality, consumers may experience problems such as leakage, power failure, low vapor volume, and poor quality of cigarette liquid during use, which not only brings a bad experience to consumers, but also brings a bad reputation to the electronic cigarette enterprises of genuine products. How to carry out anti counterfeiting and a genuine product verification of the vaporizer assembly of the electronic cigarettes, and prevent the use of bad substitutes, the existing electronic cigarettes do not effectively solve this problem.

SUMMARY

Technical Problem

An object of the present disclosure is to provide an electronic cigarette with a two-wire encryption chip for anti-counterfeiting in order to overcome the deficiencies of the above-mentioned technology. The electronic cigarette with a two-wire encryption chip for anti-counterfeiting is capable of effectively identifying and preventing counterfeiting of vaporizer assembly of genuine electronic cigarettes by means of adding a chip in the vaporizer assembly of the electronic cigarette.

Technical Solution

The technical solution of the present disclosure is achieved as follows, an electronic cigarette with a two-wire encryption chip for anti-counterfeiting, including a vaporizer assembly and a battery assembly that are detachably connected, wherein the vaporizer assembly includes a two-wire encryption chip and a heating element for heating and vaporizing cigarette liquid, the two-wire encryption chip is preset with an anti-counterfeit code, both ends of the heating element are connected to positive and negative electrodes of the vaporizer assembly respectively, and the two-wire encryption chip is provided with two pins connected to the positive and negative electrodes of the vaporizer assembly respectively, the battery assembly includes a battery, a circuit board, and positive and negative electrodes of the battery assembly, the circuit board is provided with a microcontroller and a switching circuit, and the microcontroller is preset with an anti-counterfeit code, when the vaporizer assembly and the battery assembly are connected, the positive and negative electrodes of the vaporizer assembly are respectively in contact with the positive and negative electrodes of the battery assembly, and the two-wire encryption chip is thus electrically connected to the microcontroller, the microcontroller reads the anti-counterfeit code preset in the two-wire encryption chip and then compares it with the anti-counterfeit code preset in the microcontroller for verification, if the two anti-counterfeit codes are the same, the microcontroller turns on the switching circuit, and the electronic cigarette enters a standby state.

Preferably, the two-wire encryption chip and the heating element may be electrically connected to the positive and negative electrodes of the vaporizer assembly by means of the switching circuit, the switching circuit may include a first MOS transistor, a first pin of the two-wire encryption chip may be connected to a D electrode of the first MOS transistor and one end of the heating element simultaneously, and a second pin of the two-wire encryption chip may be connected to an S electrode of the first MOS transistor and the negative electrode of the vaporizer assembly simultaneously, a G electrode of the first MOS transistor may be connected to the positive electrode of the vaporizer assembly and the other end of the heating element, and thus the two-wire encryption chip may be capable of transmitting data by means of the positive and negative electrodes of the vaporizer assembly when the heating element is not powered on.

Preferably, the circuit board may be provided with a data transmission circuit for transmitting data for the two-wire encryption chip, the data transmission circuit may include a second MOS transistor and a third MOS transistor, wherein a D electrode of the second MOS transistor may be connected to a write signal terminal TX and one end of a resistor R14 simultaneously, and the other end of the resistor R14 may be connected to a power supply signal terminal VDD. A G electrode of the second MOS transistor may be connected to one end of a resistor R22, and the other end of the resistor R22 may be connected to the positive electrode of the battery assembly. An S electrode of the second MOS transistor and an S electrode of the third MOS transistor may be simultaneously connected to the negative electrode of the battery assembly and grounded. A G electrode of the third MOS transistor may be connected to one end of a resistor R19, and the other end of the resistor R19 may be connected to a read signal terminal RX. A D electrode of the third MOS transistor may be connected to the positive electrode of the battery assembly, the positive electrode of the battery assembly may also be connected to one end of a resistor R15, the other end of the resistor R15 may be connected to one end of a resistor R31 and a negative electrode of a diode D1 simultaneously, the other end of the resistor R31 may be connected to an enable signal terminal EN, and a positive electrode of the diode D1 may be connected to the negative electrode of the battery assembly.

Preferably, the microcontroller may be provided with 28 pins, wherein a 3rd pin may be connected to the power supply signal terminal VDD, a 4th pin may be grounded, a 7th pin may be connected to the enable signal terminal EN, an 8th pin may be connected to a first voltage signal terminal R-DET of the heating element, a 9th pin may be connected to a second voltage signal terminal I-DET of the heating element, a 12th pin may be connected to a microphone signal terminal MIC, a 14th pin may be connected to a resistance measurement enable signal terminal R-DET-EN, a 22nd pin may be connected to the write signal terminal TX, a 27th pin may be connected to the read signal terminal RX, and a 28th pin may be connected to an output enable signal terminal PWM-EN.

Preferably, the circuit board may include an output detection circuit, and the output detection circuit may include a fourth MOS transistor and a fifth MOS transistor, each of which includes 8 pins, wherein a 1st pin, a 2nd pin, a 6th pin, a 7th pin, and an 8th pin of each of the fourth MOS transistor and the fifth MOS transistor may be combined into a D electrode of each, and a 3rd pin of each may be a G electrode of each, a 4th pin and a 5th pin of each may be combined into an S electrode of each. The D electrode of the fifth MOS transistor may be connected to an output voltage signal terminal PWM-OUT of the heating element, and the D electrode of the fifth MOS transistor may also be connected to the second voltage signal terminal I-DET of the heating element after being connected to a resistor R3 simultaneously. The second voltage signal terminal I-DET of the heating element may be connected in parallel with a resistor R33 and a capacitor C2 and then grounded. The D electrode of the fourth MOS transistor may be connected to a resistor R11 and then connected to the first voltage signal terminal R-DET of the heating element, the first voltage signal terminal R-DET of the heating element may be connected in parallel with a resistor R24 and a capacitor C1 and then grounded, and a resistor R5 may be connected between the D electrode of the fourth MOS transistor and the D electrode of the fifth MOS transistor. A resistor R7 may be connected in series between the G electrode and the S electrode of the fifth MOS transistor, a resistor R1 may be connected in series between the G electrode and the S electrode of the fourth MOS transistor, and the S electrode of the fifth MOS transistor may be directly connected to the S electrode of the fourth MOS transistor and connected to a power supply signal BAT+, the G electrode of the fifth MOS transistor may be connected to the output enable signal terminal PWM-EN, and the G electrode of the fourth MOS transistor may be connected to the resistance measurement enable signal terminal R-DET-EN.

Preferably, the circuit board may include a power supply circuit, the power supply circuit may include a power supply chip, and the power supply chip may be provided with 4 pins, wherein a pin A1 and a pin B1 may be directly connected and may be connected to the power supply signal BAT+, one end of a capacitor C12, and one end of a capacitor C5 simultaneously, and the other ends of the capacitor C12 and the capacitor C5 may be grounded. A pin A2 may be connected to the power supply signal terminal VDD and may be connected to one end of a capacitor C13 and one end of a capacitor C3 simultaneously, and the other ends of the capacitor C13 and the capacitor C3 may be grounded. A voltage stabilizing diode D4 may be connected in series between the pin A2 and the pin A1, and a pin B2 may be grounded.

Preferably, when the microcontroller turns on the switching circuit, the microcontroller may randomly generate a new anti-counterfeit code according to a set program and then send it to the two-wire encryption chip, and the two-wire encryption chip may save the new anti-counterfeit code for use in a next verification.

Preferably, the microcontroller may be provided with preset standby time, and if standby time exceeds the preset standby time, the microcontroller controls the switching circuit to open.

Preferably, the vaporizer assembly or the battery assembly may further include a vaping trigger switch, and the vaping trigger switch may be a microphone-type automatic airflow switch or a digital automatic pressure switch.

Preferably, a display unit or an indication unit may be provided on the vaporizer assembly or the battery assembly, the display unit or the indication unit may be electrically connected with the microcontroller, and the indication unit may include a buzzer, an LED indication, or a vibrator.

Beneficial Effect

The electronic cigarette with a two-wire encryption chip for anti-counterfeiting is capable of effectively identifying and preventing counterfeiting of a vaporizer assembly of a genuine electronic cigarette by means of adding a chip in the vaporizer assembly of the electronic cigarette.

DETAILED DESCRIPTION

Figure 1:
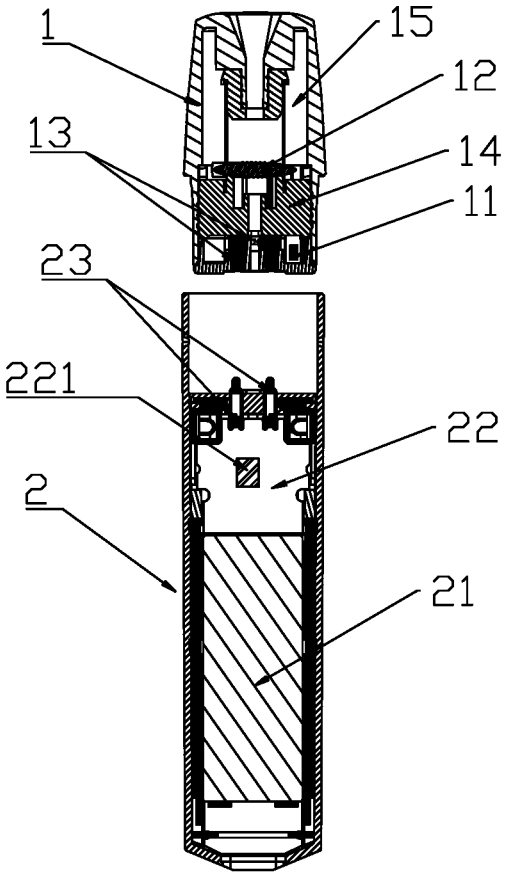
FIG. 1 is a sectional view of a detached structure of an electronic cigarette of the present disclosure.

Referring to FIG. 1, an electronic cigarette with a two-wire encryption chip for anti-counterfeiting according to the present disclosure, including a vaporizer assembly 1 and a battery assembly 2 that are detachably connected, wherein when the electronic cigarette is not in use, the vaporizer assembly 1 may be detached from the battery assembly 2, and when the electronic cigarette is in use, the vaporizer assembly 1 may be inserted into the battery assembly 2 to connect and use. The vaporizer assembly 1 includes a two-wire encryption chip 11 and a heating element 12 for heating and vaporizing cigarette liquid. The two-wire encryption chip 11 is preset with an anti-counterfeit code. Both ends of the heating element 12 are connected to positive and negative electrodes 13 of the vaporizer assembly respectively. The two-wire encryption chip 11 is provided with two pins connected to the positive and negative electrodes 13 of the vaporizer assembly respectively. Further, the vaporizer assembly 1 may also include other components such as a vaporization seat 14 and a liquid storage chamber 15.

The battery assembly 2 includes a battery 21, a circuit board 22, and positive and negative electrodes 23 of the battery assembly. The circuit board 22 is provided with a microcontroller 221 and a switching circuit (not shown in the figure), and the microcontroller 221 is preset with an anti-counterfeit code. When the vaporizer assembly 1 and the battery assembly 2 is connected, the positive and negative electrodes 13 of the vaporizer assembly are respectively in contact with the positive and negative electrodes 23 of the battery assembly, and the two-wire encryption chip 11 is thus electrically connected to the microcontroller 221. The microcontroller 221 reads the anti-counterfeit code preset in the two-wire encryption chip 11 and then compares it with the anti-counterfeit code preset in the microcontroller for verification, if the two anti-counterfeit codes are the same, the microcontroller 221 turns on the switching circuit, and the electronic cigarette enters a standby state.

Figure 2:
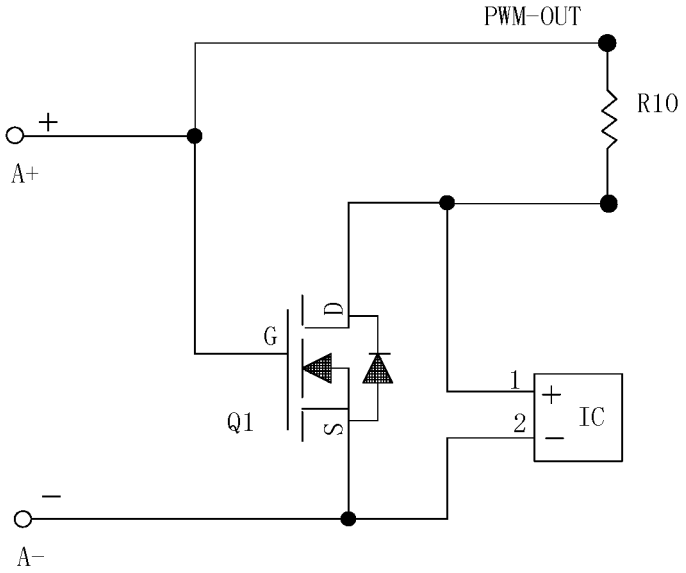
FIG. 2 is a chip switching circuit diagram of an electronic cigarette of the present disclosure.

Referring to FIG. 2, the two-wire encryption chip IC and the heating element R10 are electrically connected to the positive electrode A+ and the negative electrode A− of a vaporizer assembly by means of a switching circuit. The switching circuit includes a first MOS transistor Q1. A first pin 1 of the two-wire encryption chip IC is connected to a D (Drain) electrode of the first MOS transistor Q1 and one end of the heating element R10 simultaneously. A second pin 2 of the two-wire encryption chip IC is connected to an S (Source) electrode of the first MOS transistor Q1 and the negative electrode A− of the vaporizer assembly simultaneously. A G (Gate) electrode of the first MOS transistor Q1 is connected to the positive electrode A+ of the vaporizer assembly and the other end of the heating element R10 simultaneously. And thus the two-wire encryption chip IC may be capable of transmitting data by means of the positive electrode A+ and the negative electrode A− of the vaporizer assembly when the heating element R10 is not powered on.

When the positive electrode A+ of the vaporizer assembly has a high level, a G electrode of the first MOS transistor Q1 also has a high level, thus the D electrode and the S electrode are conducted, and the heating element R10 is powered on to work. In such a case, the two pins of the two-wire encryption chip IC have equal levels and do not operate. When the positive electrode A+ of the vaporizer assembly has a low level, the G electrode of the first MOS transistor Q1 also has a low level, thus the D electrode and the S electrode are not conducted, and the heating element R10 is not powered on. In such a case, the two pins of the two-wire encryption chip IC are respectively connected to the positive electrode A+ and the negative electrode A− of the vaporizer assembly, and the positive electrode A+ and the negative electrode A− of the vaporizer assembly are connected to the microcontroller 221 by means of the positive electrode B+ and the negative electrode B− of the battery assembly.

Figure 3:
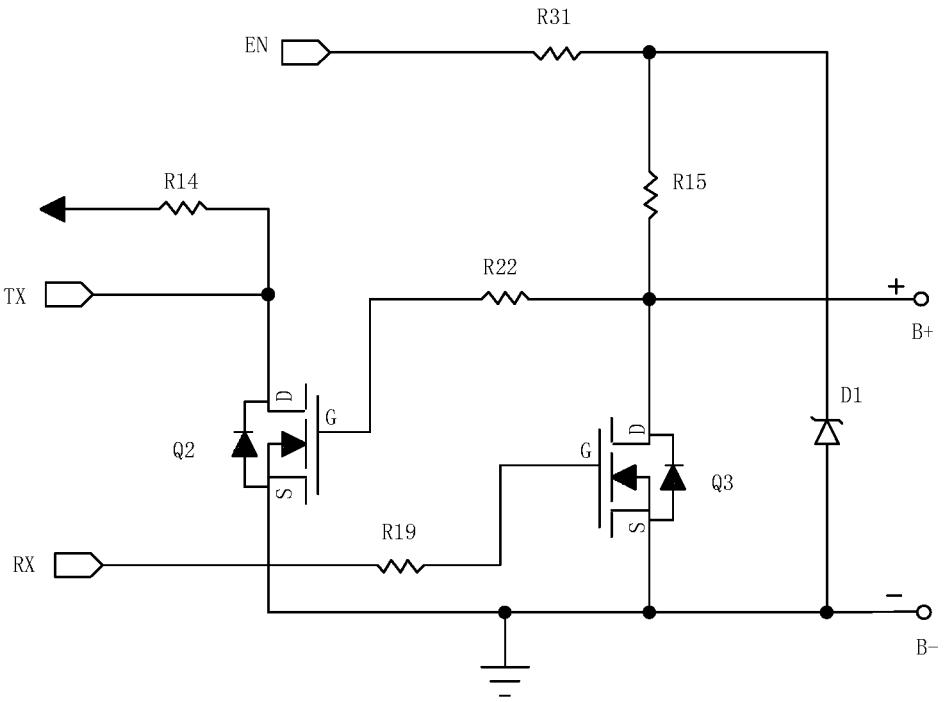
FIG. 3 is a circuit diagram of a data transmission circuit of an electronic cigarette of the present disclosure.

Referring to FIG. 3, the circuit board may be provided with a data transmission circuit for transmitting data for the two-wire encryption chip IC. The data transmission circuit includes a second MOS transistor Q2 and a third MOS transistor Q3, wherein a D electrode of the second MOS transistor Q2 is connected to a write signal terminal TX and one end of a resistor R14 simultaneously, and the other end of the resistor R14 is connected to a power supply signal terminal VDD. A G electrode of the second MOS transistor Q2 is connected to one end of a resistor R22, and the other end of the resistor R22 is connected to a positive electrode B+ of the battery assembly. An S electrode of the second MOS transistor Q2 and an S electrode of the third MOS transistor Q3 are simultaneously connected to a negative electrode B− of the battery assembly and grounded. A G electrode of the third MOS transistor Q3 is connected to one end of a resistor R19, and the other end of the resistor R19 is connected to a read signal terminal RX. A D electrode of the third MOS transistor Q3 is connected to the positive electrode B+ of the battery assembly, the positive electrode B+ of the battery assembly is also connected to one end of a resistor R15, the other end of the resistor R15 is connected to one end of a resistor R31 and a negative electrode of a diode D1 simultaneously, the other end of the resistor R31 is connected to an enable signal terminal EN, and a positive electrode of the diode D1 is connected to the negative electrode B− of the battery assembly.

Figure 4:
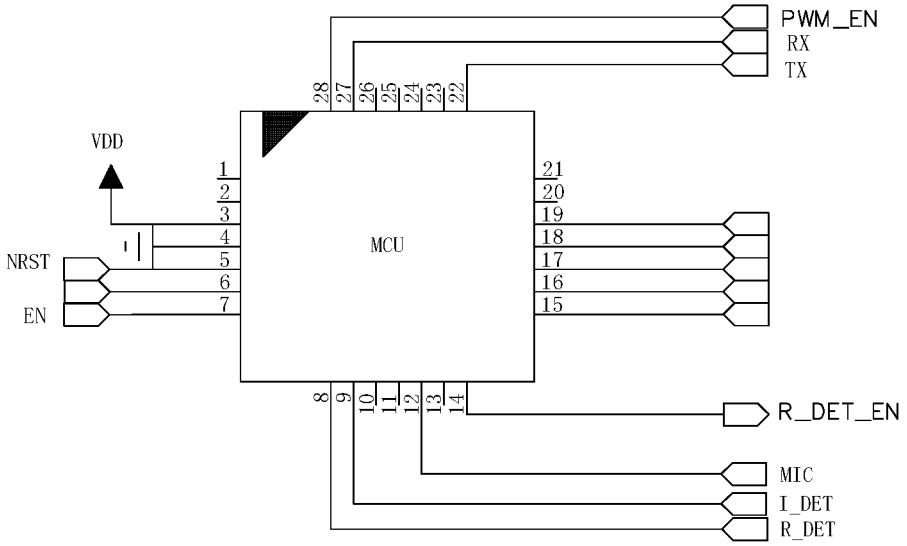
FIG. 4 is a schematic diagram of signal terminals of a two-wire encryption chip of an electronic cigarette of the present disclosure.

Referring to FIG. 4, the microcontroller may be provided with 28 pins, wherein a 3rd pin is connected to the power supply signal terminal VDD, a 4th pin is grounded, a 7th pin is connected to the enable signal terminal EN, an 8th pin is connected to a first voltage signal terminal R-DET of the heating element, a 9th pin is connected to a second voltage signal terminal I-DET of the heating element, a 12th pin is connected to a microphone signal terminal MIC, a 14th pin is connected to a resistance measurement enable signal terminal R-DET-EN, a 22nd pin is connected to the write signal terminal TX, a 27th pin is connected to the read signal terminal RX, and a 28th pin is connected to an output enable signal terminal PWM-EN.

Figure 5:
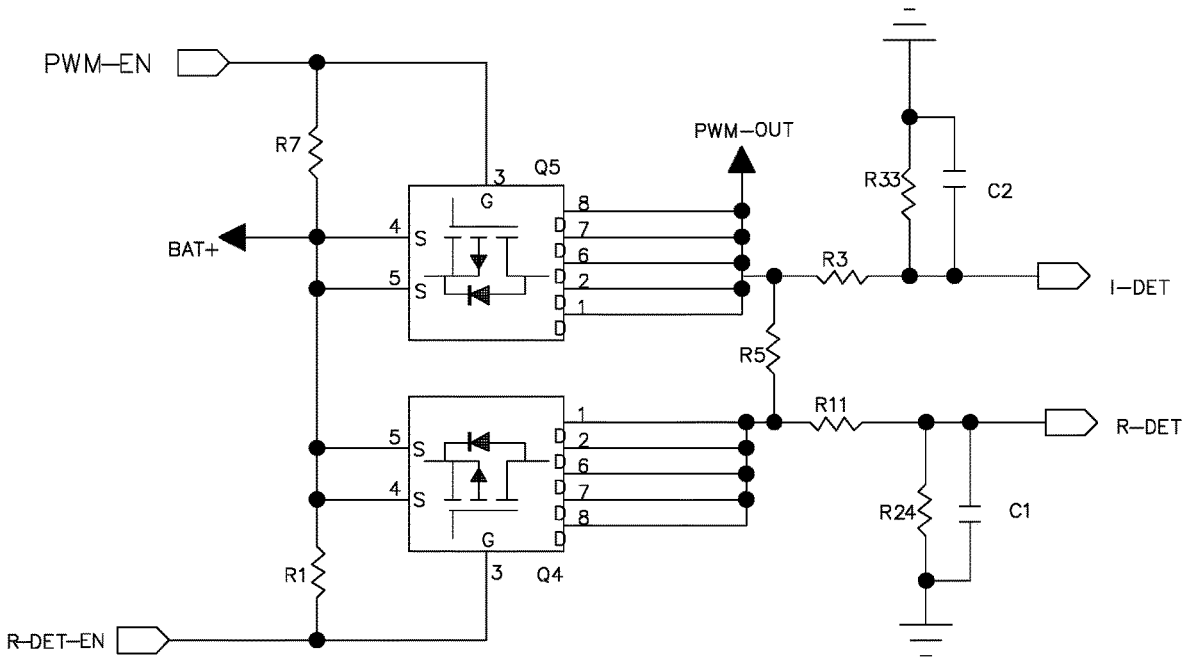
FIG. 5 is a circuit diagram of an output detection circuit of an electronic cigarette of the present disclosure.

Referring to FIG. 5, the circuit board may include an output detection circuit, and the output detection circuit includes a fourth MOS transistor Q4 and a fifth MOS transistor Q5, each of which includes 8 pins, wherein a 1st pin, a 2nd pin, a 6th pin, a 7th pin, and an 8th pin of each of the fourth MOS transistor Q4 and the fifth MOS transistor Q5 are combined into a D electrode of each, and a 3rd pin of each is a G electrode of each, a 4th pin and a 5th pin of each are combined into an S electrode of each. The D electrode of the fifth MOS transistor Q5 is connected to an output voltage signal terminal PWM-OUT of the heating element, and the D electrode of the fifth MOS transistor Q5 is also connected to the second voltage signal terminal I-DET of the heating element after being connected to a resistor R3 simultaneously. The second voltage signal terminal I-DET of the heating element is connected in parallel with a resistor R33 and a capacitor C2 and then grounded. The D electrode of the fourth MOS transistor Q4 is connected to a resistor R11 and then connected to the first voltage signal terminal R-DET of the heating element, the first voltage signal terminal R-DET of the heating element is connected in parallel with a resistor R24 and a capacitor C1 and then grounded, and a resistor R5 is connected between the D electrode of the fourth MOS transistor Q4 and the D electrode of the fifth MOS transistor Q5. A resistor R7 is connected in series between the G electrode and the S electrode of the fifth MOS transistor Q5, a resistor R1 is connected in series between the G electrode and the S electrode of the fourth MOS transistor Q4, and the S electrode of the fifth MOS transistor Q5 is directly connected to the S electrode of the fourth MOS transistor Q4 and connected to a power supply signal BAT+, the G electrode of the fifth MOS transistor Q5 is connected to the output enable signal terminal PWM-EN, and the G electrode of the fourth MOS transistor Q4 is connected to the resistance measurement enable signal terminal R-DET-EN.

Figure 6:
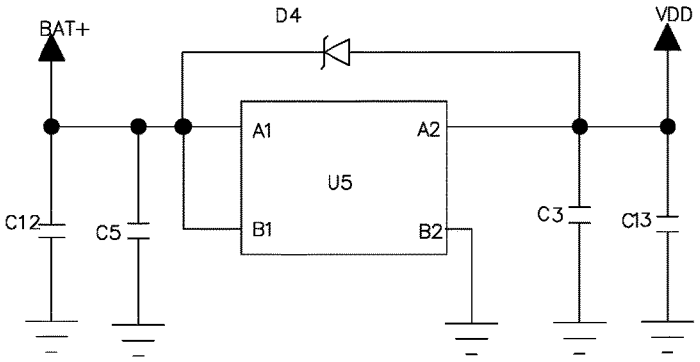
FIG. 6 is a circuit diagram of a power supply circuit of an electronic cigarette of the present disclosure.

Referring to FIG. 6, the circuit board may include a power supply circuit, the power supply circuit includes a power supply chip US, and the power supply chip US is provided with 4 pins, wherein a pin A1 and a pin B1 are directly connected and are connected to the power supply signal BAT+, one end of a capacitor C12, and one end of a capacitor C5 simultaneously, and the other ends of the capacitor C12 and the capacitor C5 are grounded. A pin A2 is connected to the power supply signal terminal VDD and may be connected to one end of a capacitor C13 and one end of a capacitor C3 simultaneously, and the other ends of the capacitor C13 and the capacitor C3 are grounded. A voltage stabilizing diode D4 is connected in series between the pin A2 and the pin A1, and a pin B2 is grounded.

Referring to FIG. 1, the electronic cigarette with a two-wire encryption chip for anti-counterfeiting according to the present disclosure may also adopt a dynamic password technology. When the microcontroller 221 turns on the switching circuit for powering on the electronic cigarette, the microcontroller 221 randomly and dynamically generates a new anti-counterfeit code according to a set program and then sends it to the two-wire encryption chip 11, and the two-wire encryption chip 11 saves the new anti-counterfeit code for use in a next verification. The new anti-counterfeit code may include a fixed code and a dynamic code, wherein the dynamic code is randomly generated according to the set program.

The microcontroller 221 may be provided with preset standby time, and if standby time exceeds the preset standby time, the microcontroller 221 controls the switching circuit to open.

The vaporizer assembly 1 or the battery assembly 2 may further include a vaping trigger switch (not shown in the figures), and the vaping trigger switch of the embodiment is a digital automatic pressure switch, the vaping trigger switch of other embodiments may be a microphone-type automatic airflow switch.

A display unit or an indication unit (not shown in the figures) may be provided on the vaporizer assembly 1 or the battery assembly 2, the display unit or the indication unit is electrically connected with the microcontroller 221 to display relevant information for reference of a user or to provide an alarm or indication. The indication unit may include a buzzer, an LED indication, or a vibrator.

The microcontroller 221 and the microcontroller MCU described in the different figures are the same components, the two-wire encryption chip 11 and the two-wire encryption chip IC are also the same components, and the heating element 12 and the heating element R10 are also the same components. The positive electrode A+ and the negative electrode A− of the vaporizer assembly are the same as the positive and negative electrodes 13 of the vaporizer assembly, and the positive electrode B+ and the negative electrode B− of the battery assembly are the same as the positive and negative electrodes 23 of the battery assembly.

INDUSTRIAL APPLICABILITY

The above descriptions are only preferred embodiments of the present disclosure, and all equivalent changes and modifications made according to the scope of the claims of the present disclosure shall fall within the scope of the claims of the present disclosure.

The invention claimed is:

1. An electronic cigarette with a two-wire encryption chip for anti-counterfeiting, comprising a vaporizer assembly and a battery assembly that are detachably connected, wherein the vaporizer assembly comprises a two-wire encryption chip and a heating element for heating and vaporizing cigarette liquid, the two-wire encryption chip is preset with an anti-counterfeit code, and two ends of the heating element are connected to positive and negative electrodes of the vaporizer assembly respectively, the two-wire encryption chip is provided with two pins connected to the positive and negative electrodes of the vaporizer assembly respectively, the battery assembly comprises a battery, a circuit board, and positive and negative electrodes of the battery assembly, the circuit board is provided with a microcontroller and a switching circuit, and the microcontroller is preset with an anti-counterfeit code, responsive to the vaporizer assembly and the battery assembly are connected, the positive and negative electrodes of the vaporizer assembly are respectively in contact with the positive and negative electrodes of the battery assembly, and the two-wire encryption chip is thus electrically connected to the microcontroller, the microcontroller reads the anti-counterfeit code preset in the two-wire encryption chip and then compares it with the anti-counterfeit code preset in the microcontroller for verification, in a case that the two anti-counterfeit codes are the same, the microcontroller turns on the switching circuit, and the electronic cigarette enters a standby state; and wherein the two-wire encryption chip and the heating element are electrically connected to the positive and negative electrodes of the vaporizer assembly by means of the switching circuit, the switching circuit comprises a first metal-oxide semiconductor field effect transistor (MOS transistor), a first pin of the two-wire encryption chip is connected to an electrode (D) of the first MOS transistor and one end of the heating element simultaneously, a second pin of the two-wire encryption chip is connected to an electrode(S) of the first MOS transistor and the negative electrode of the vaporizer assembly simultaneously, an electrode (G) of the first MOS transistor is connected to the positive electrode of the vaporizer assembly and the other end of the heating element simultaneously, and thus the two-wire encryption chip is capable of transmitting data by means of the positive and negative electrodes of the vaporizer assembly, responsive to the heating element is not powered on.

2. The electronic cigarette with a two-wire encryption chip for anti-counterfeiting according to claim 1, wherein the circuit board is provided with a data transmission circuit for transmitting data for the two-wire encryption chip, the data transmission circuit comprises a second MOS transistor and a third MOS transistor, an electrode (D) of the second MOS transistor is connected to a write signal terminal (TX) and one end of a resistor (R14) simultaneously, and an other end of the resistor (R14) is connected to a power supply signal terminal (VDD), an electrode (G) of the second MOS transistor is connected to one end of a resistor (R22), and an other end of the resistor (R22) is connected to the positive electrode of the battery assembly, an electrode(S) of the second MOS transistor and an electrode(S) of the third MOS transistor are simultaneously connected to the negative electrode of the battery assembly and grounded, an electrode (G) of the third MOS transistor is connected to one end of a resistor (R19), and an other end of the resistor (R19) is connected to a read signal terminal (RX), an electrode (D) of the third MOS transistor is connected to the positive electrode of the battery assembly, the positive electrode of the battery assembly is also connected to one end of a resistor (R15), an other end of the resistor (R15) is connected to one end of a resistor (R31) and a negative electrode of a diode (D1) simultaneously, an other end of the resistor (R31) is connected to an enable signal terminal (EN), and a positive electrode of the diode (D1) is connected to the negative electrode of the battery assembly.

3. The electronic cigarette with a two-wire encryption chip for anti-counterfeiting according to claim 1, wherein the microcontroller is provided with 28 pins, a 3rd pin is connected to a power supply signal terminal (VDD), a 4th pin is grounded, a 7th pin is connected to an enable signal terminal (EN), an 8th pin is connected to a first voltage signal terminal (R-DET) of the heating element, a 9th pin is connected to a second voltage signal terminal (I-DET) of the heating element, a 12th pin is connected to a microphone signal terminal (MIC), a 14th pin is connected to a resistance measurement enable signal terminal (R-DET-EN), a 22nd pin is connected to a write signal terminal (TX), a 27th pin is connected to a read signal terminal (RX), and a 28th pin is connected to an output enable signal terminal (PWM-EN).

4. The electronic cigarette with a two-wire encryption chip for anti-counterfeiting according to claim 2, wherein the circuit board comprises an output detection circuit, the output detection circuit comprises a fourth MOS transistor and a fifth MOS transistor, each of which comprises 8 pins, and a 1st pin, a 2nd pin, a 6th pin, a 7th pin, and an 8th pin of each of the fourth MOS transistor and the fifth MOS transistor are combined into an electrode (D) of each, a 3rd pin of each is an electrode (G) of each, and a 4th pin and a 5th pin of each are combined into an electrode(S) of each, the electrode (D) of the fifth MOS transistor is connected to an output voltage signal terminal (PWM-OUT) of the heating element, and the electrode (D) of the fifth MOS transistor is also connected to a second voltage signal terminal (I-DET) of the heating element after being connected to a resistor (R3) simultaneously, the second voltage signal terminal (I-DET) of the heating element is connected in parallel with a resistor (R33) and a capacitor (C2) and then grounded, the electrode (D) of the fourth MOS transistor is connected to a resistor (R11) and then connected to a first voltage signal terminal (R-DET) of the heating element, the first voltage signal terminal (R-DET) of the heating element is connected in parallel with a resistor (R24) and a capacitor (C1) and then grounded, and a resistor (R5) is connected between the electrode (D) of the fourth MOS transistor and the electrode (D) of the fifth MOS transistor; a resistor (R7) is connected in series between the electrode (G) and the electrode(S) of the fifth MOS transistor, a resistor (R1) is connected in series between the electrode (G) and the electrode(S) of the fourth MOS transistor, and the electrode (S) of the fifth MOS transistor is directly connected to the electrode(S) of the fourth MOS transistor and connected to a power supply signal (BAT+), the electrode (G) of the fifth MOS transistor is connected to an output enable signal terminal (PWM-EN), and the electrode (G) of the fourth MOS transistor is connected to a resistance measurement enable signal terminal (R-DET-EN).

5. The electronic cigarette with a two-wire encryption chip for anti-counterfeiting according to claim 1, wherein the circuit board comprises a power supply circuit, and the power supply circuit comprises a power supply chip, the power supply chip is provided with 4 pins, wherein a pin (A1) and a pin (B1) are directly connected and are connected to a power supply signal (BAT+), one end of a capacitor (C12), and one end of a capacitor (C5) simultaneously, and other ends of the capacitor (C12) and the capacitor (C5) are grounded, a pin (A2) is connected to a power supply signal terminal (VDD) and is connected to one end of a capacitor (C13) and one end of a capacitor (C3) simultaneously, and other ends of the capacitor (C13) and the capacitor (C3) are grounded, a voltage stabilizing diode (D4) is connected in series between the pin (A2) and the pin (A1), and a pin (B2) is grounded.

6. The electronic cigarette with a two-wire encryption chip for anti-counterfeiting according to claim 1, wherein responsive to the microcontroller turns on the switching circuit, the microcontroller randomly generates a new anti-counterfeit code according to a set program and then sends it to the two-wire encryption chip, and the two-wire encryption chip saves the new anti-counterfeit code for use in a next verification.

7. The electronic cigarette with a two-wire encryption chip for anti-counterfeiting according to claim 1, wherein the microcontroller is provided with preset standby time, and responsive to standby time exceeds the preset standby time, the microcontroller controls the switching circuit to open.

8. The electronic cigarette with a two-wire encryption chip for anti-counterfeiting according to claim 1, wherein the vaporizer assembly or the battery assembly further comprises a vaping trigger switch, and the vaping trigger switch is a microphone-type automatic airflow switch or a digital automatic pressure switch.

9. The electronic cigarette with a two-wire encryption chip for anti-counterfeiting according to claim 1, wherein a display unit or an indication unit is provided on the vaporizer assembly or the battery assembly, the display unit or the indication unit is electrically connected with the microcontroller, and the indication unit comprises a buzzer, an LED indication, or a vibrator.

* * * * *